US005836856A

United States Patent [19]

Mattoo et al.

[11] Patent Number: 5,836,856

[45] Date of Patent: Nov. 17, 1998

[54] EXERCISE DEVICE

[76] Inventors: Sukhraj Singh Mattoo, 78 Somerset Road, Southall, Middlesex UB1 2TU; Bhupinder Singh Padda, 296 Oldfield Lane, Greenford, Middlesex UB6 8PS, both of United Kingdom

[21] Appl. No.: 620,336

[22] Filed: Mar. 22, 1996

[51] Int. Cl.[6] ..... A63B 69/06; A63B 22/12

[52] U.S. Cl. ..... 482/62; 482/57

[58] Field of Search ..... 482/51, 52, 53, 482/60, 57, 62

[56] References Cited

U.S. PATENT DOCUMENTS

| | | | |
|---|---|---|---|
| 3,058,742 | 10/1962 | Jaffe | 482/60 |
| 3,704,886 | 12/1972 | Kay et al. | 482/62 |
| 4,285,515 | 8/1981 | Gezari | 482/57 |
| 4,700,962 | 10/1987 | Salmon | 482/62 |
| 4,705,269 | 11/1987 | De Boer et al. | 482/62 |
| 4,798,395 | 1/1989 | Shaffer et al. | 482/62 |
| 4,842,268 | 6/1989 | Jenkins | 482/62 |
| 4,871,164 | 10/1989 | Tseng | 482/62 |
| 4,902,001 | 2/1990 | Balbo | 482/57 |
| 5,016,870 | 5/1991 | Bulloch et al. | 482/62 |
| 5,062,627 | 11/1991 | Bingham | 482/53 |
| 5,256,117 | 10/1993 | Potts et al. | 482/62 |
| 5,356,356 | 10/1994 | Hildebrandt et al. | 482/57 |
| 5,431,614 | 7/1995 | Jeranson | 482/62 |
| 5,433,680 | 7/1995 | Knudson | 482/57 |
| 5,496,236 | 3/1996 | Buonavito | 482/57 |
| 5,501,648 | 3/1996 | Grigoriev | 482/57 |
| 5,503,607 | 4/1996 | Lo | 482/52 |
| 5,542,893 | 8/1996 | Peterson et al. | 482/62 |
| 5,573,481 | 11/1996 | Piercy et al. | 482/57 |
| 5,653,663 | 8/1997 | McCahon | 482/62 |
| 5,690,346 | 11/1997 | Keskitalo | 482/62 |

*Primary Examiner*—Stephen R. Crow
*Attorney, Agent, or Firm*—Larson & Taylor

[57] ABSTRACT

An exercise device comprising a flywheel with two drive connections from an oscillating input, one drive connection driving the flywheel during one phase of the oscillating input and the other drive connection driving the flywheel in the same direction during the other phase of the oscillating input. The flywheel is thus driven continuously during the two phases of the oscillating input, providing an efficient form of exercise. In addition, the flywheel can be driven conventionally by foot pedals.

14 Claims, 4 Drawing Sheets

EXERCISE DEVICE

BACKGROUND

1. Field of the Invention

This invention relates to an exercise device in which the user exerts energy to turn a flywheel which may be braked.

2. Prior Art

Conventional exercise bicycles have a pair of pedals fitted directly to the flywheel or through a bicycle-type chain drive. The braking of the flywheel can be adjustable in order to adjust the effort required to turn it.

Exercise bicycles do not provide means for exercising the other limbs and arm exercising machines usually work on different principles, for example moving levers against springs or shock absorber-type units.

The aim of the present invention is to provide an exercise device comprising a flywheel which can be used to exercise both the arms and the legs of the user. The invention is set out in claim 1.

BRIEF DESCRIPTION OF THE DRAWINGS

An example of the invention will now be described with reference to the accompanying drawings in which.

DETAILED DESCRIPTION OF THE PREFERRED EMBODIMENTS

Figure 1:
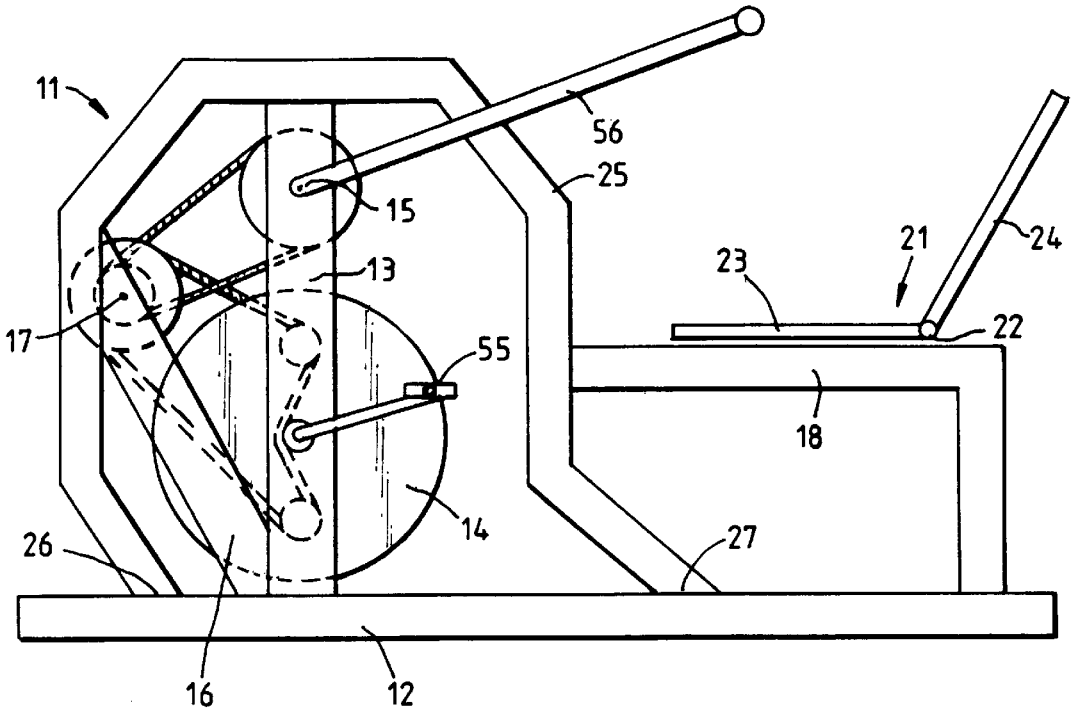
FIG. 1 is a side elevation of an exercise machine according to one embodiment of the invention.

The exercise device of FIGS. 1 to 5 comprises a frame 11 having a base member 12, a main vertical member 13 which supports a flywheel 14 for rotation at its lower portion and an input drive shaft 15 at its upper portion. The frame is also provided with a diagonal member 16 on which is mounted an intermediate drive shaft 17. A seat bracket 18 supports a seat 21 formed in two parts hinged together at 22, comprising a main seat portion 23 secured to the bracket 18 and a back portion 24 which can be raised to the position illustrated in FIG. 1 to support the user's back or hinged downwards to extend parallel to the main portion 23 so that the whole seat then forms a bench on which the user can lie. The free ends of the seat bracket 18, the vertical member 13 and the diagonal member 16 are secured together by a loop frame 25 secured at two places 26 and 27 to the base member 12. The seat portion can be adjustable towards and away from the frame 25 to suit the reach of the user, and its height can also be adjusted. The width of the frame 25 is of the order of 50 cm in order to allow the user's limbs to extend on either side of the frame without discomfort.

Figure 2:
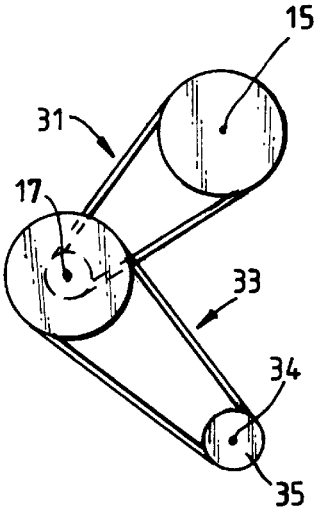
FIG. 2 is a diagram of one of the two drive means of the apparatus of FIG. 1.
Figure 4:
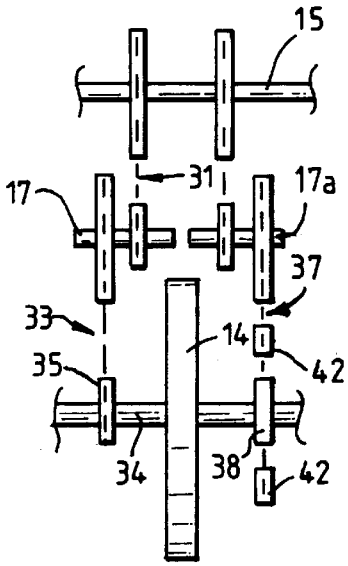
FIG. 4 is a diagrammatic end elevation of the two drive means of FIG. 1.
Figure 3:
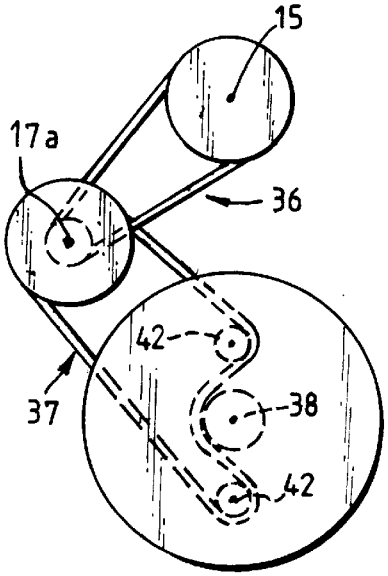
FIG. 3 is a diagram of the other of the two drive means of the apparatus of FIG. 1.
Figure 5:
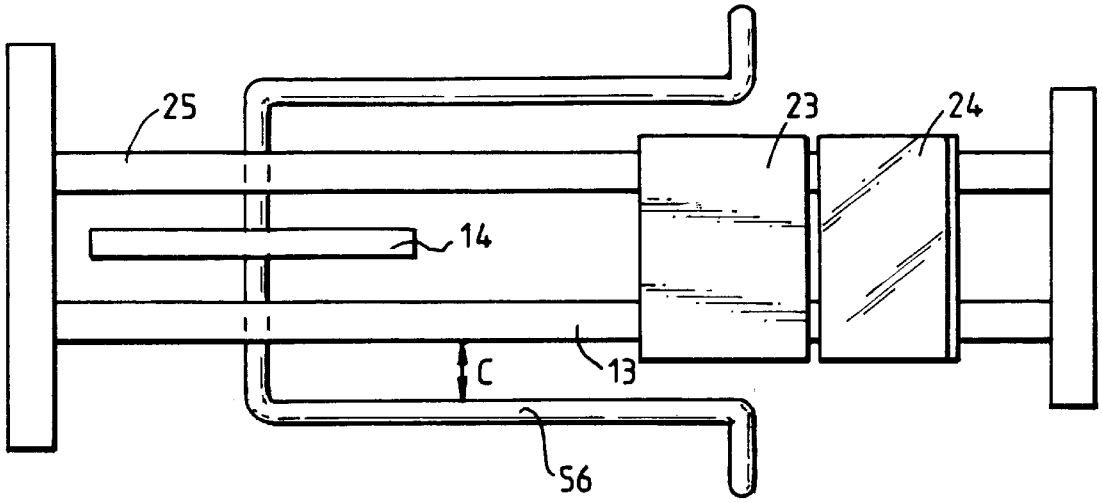
FIG. 5 is a plan view of the apparatus of FIG. 1, FIGS. 6 to 8 show one splined end of the input shaft in conjunction with, in FIG. 6, a long-armed handle, in FIG. 7, a short-armed handle, and in FIG. 8, a foot pedal (represented diagrammatically)

FIGS. 2 and 3 show the two chain drive mechanisms for connecting the input drive shaft to the flywheel. The drive mechanism of FIG. 2 comprises two gearing-up chain and sprocket drives, the first drive 31 between the input shaft 15 and the intermediate shaft 17 and the second drive 33 between the intermediate shaft 17 and the shaft 34 of the flywheel. Each drive 31 and 33 provides a gearing-up of approximately 2.5:1. The sprocket 35 on the flywheel shaft 34 is connected to the flywheel by means of a freewheel mechanism, so that rotation of the input shaft 15 in one direction will cause the flywheel to rotate in the same direction, but rotation of the input shaft 15 in the other direction will not be transmitted to the flywheel by the drive mechanism of FIG. 2.

The second drive mechanism 41, shown in FIG. 3, is located on the opposite side of the flywheel to the drive mechanism of FIG. 2, and provides a similar drive with a first drive 36 to an intermediate shaft 17*a* and a second drive 37 from the shaft 17*a* to a freewheel 38 on the flywheel shaft 34. The chain of the second drive 37 passes around the front of the freewheel 38 whereas the chain of the second drive 33 passes around the rear of the sprocket 35, so that the drive from the shaft 17*a* to the flywheel is reversed compared to the drive from the shaft 17 to the flywheel. In FIG. 3 additional idler sprockets 42 are provided between the intermediate drive shaft 17*a* and the freewheel 38 on the flywheel shaft to guide the chain to the front of the freewheel 38. Thus when the input shaft 15 is rotated in one direction, one drive mechanism drives the flywheel forward and when the input shaft is rotated in the other direction, the other drive mechanism drives the flywheel forward. This means that when an oscillatory rotary motion is applied to the input shaft 15, rotations of one phase will cause one drive mechanism to drive the flywheel forward while the other drive mechanism freewheels and rotation of the other phase will cause the other drive mechanism to drive the flywheel forward while the first drive mechanism freewheels.

Figure 6:
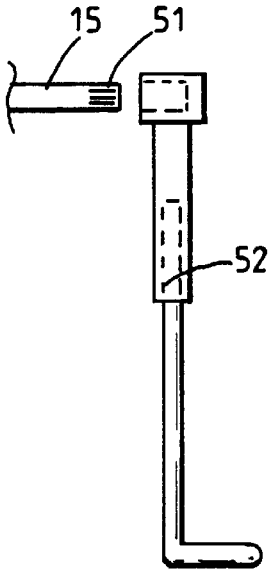
Figure 7:
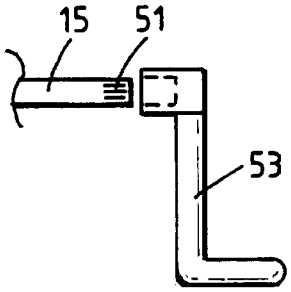
Figure 8:
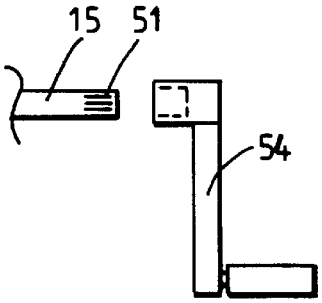

The oscillatory drive motion applied to the input shaft can be applied by means of levers, two being shown in FIG. 1. The ends of the input shaft may be provided with splines 51 so that levers of different lengths and shapes can be connected to the input shaft at will. FIGS. 6 to 8 show different levers which can be connected to the input shaft 15, according to the type of exercise to be performed. FIG. 6 shows a telescopic lever 52, adjustable in length. FIG. 7 shows a hand lever 53 for driving the shaft 15. FIG. 8 shows a foot pedal 54 which can be mounted alternatively on shaft 15 or shaft 34. The splines allow the levers to be fixed on in different azimuths relative to the axis of shaft 15, so that the applied oscillatory motion can sweep the desired range of angles.

Conventional bicycle-type pedals 55 are secured to the ends of the flywheel shaft 34 by splines similar to those shown in FIGS. 6 to 8 so that the pedals can be easily fitted when required and easily removed when not required. Alternatively the drive from the pedal levers to the shaft can be disconnected, so that levers hang free. The user of the device so far described can sit on the main seat portion with the back portion raised and use the apparatus like a conventional exercise bicycle, turning the flywheel directly by the pedals attached to the ends of the flywheel shaft by conventional means. Conventional handlebars (not shown) may be provided on the upper portion of the frame or fitted to the ends of the input shaft to assist the user in this effort.

When the upper body is to be exercised, the pedals 55 are removed from the flywheel shaft 34 (or their drive disconnected) and appropriate levers 56 are secured to the input shaft 15. Depending on the desired movement of these levers, the clearance C of the levers 56 from the sides of the apparatus frame 18 should be sufficient to allow the levers to clear the sides of the user's body. In the arrangement of the apparatus shown in FIGS. 1 and 5, the user sits on the main seat portion 23 facing the loop frame 25 with his back supported by the back portion 24 which is hinged upwards. The levers 56 secured to the input shaft 15 are raised and lowered in synchronism by the user holding on to the handles at the ends of the levers. Assuming that the flywheel 14 is arranged to rotate anti-clockwise as seen in FIG. 1, the drive mechanism of FIG. 2 is effective during raising of the levers 56 whereas during their movement the mechanism of FIG. 3 applies no drive the flywheel since the final sprocket 38 freewheels on the flywheel axis 34. During lowering of the levers, the mechanism of FIG. 2 is not effective to drive the flywheel as it final sprocket 35 freewheels on the flywheel axis but the drive mechanism of FIG. 3 is effective to drive the flywheel, still in the anti-clockwise direction as seen in FIG. 1. The user of the apparatus is thus exerting effort to drive the flywheel on both phases of the oscillatory motion of the levers. No return mechanism has to be provided for the levers, to act against the effort of the user, nor does the user have to waste time waiting for the levers to return, but can be exerting effort substantially continuously during both phases of the oscillatory motion, the only pauses being at the changes of direction of rotation of the input shaft 15.

The levers 56 illustrated in FIG. 1 can also be used when the second portion 24 of the seat is lowered to be parallel with the main portion 23 and the user lies on his back on the bench so formed to exercise different muscles, performing a bench press, in raising and lowering the levers to drive the flywheel. The device can also be used by the user kneeling or sitting on the left-hand side of the apparatus and causing the input shaft to rotate by oscillation of levers extending to the left-hand side of the apparatus.

Figure 12:
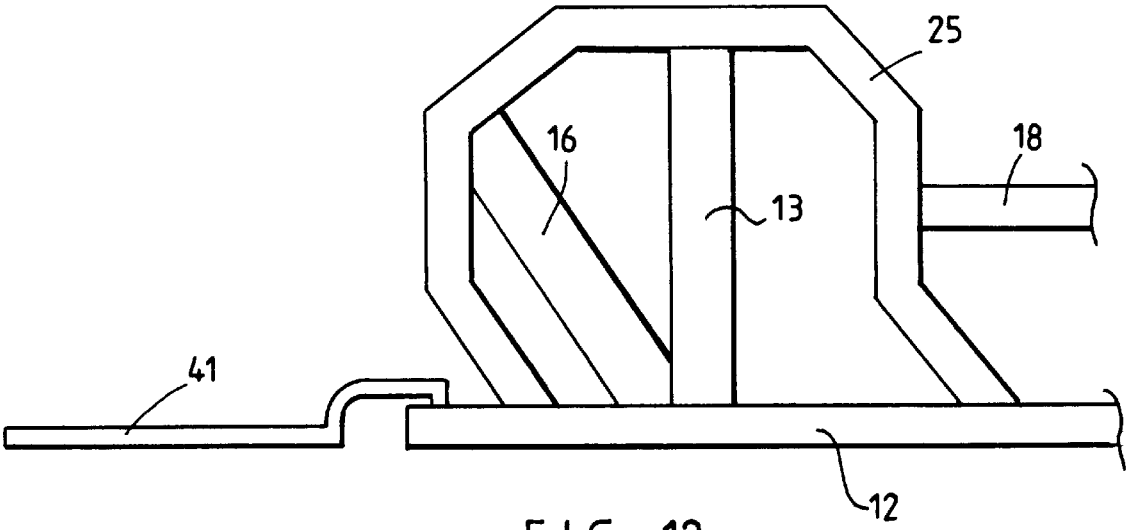
FIG. 12 shows an addition to the main frame.
Figure 13:
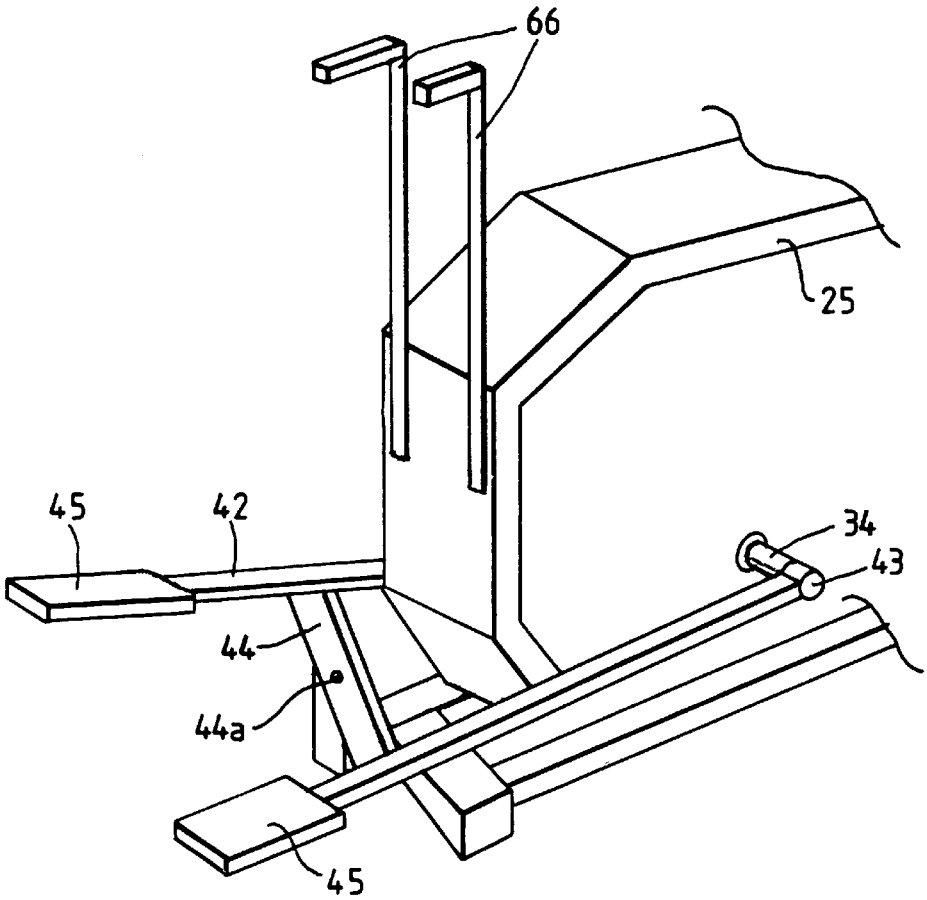
FIG. 13 shows pedal levers mounted on the flywheel shaft.

As shown in FIG. 12 a detachable counterbalance plate 41 can be fitted to the frame 12 on which the user sits or kneels to provide a reaction in the frame 25 against lifting or pushing forces he or she exerts on the levers. As shown in FIG. 13, levers 42 with ratchet connections 43 can be fitted to the ends of the flywheel shaft 34 with a lever 44 rocking about a central shaft 44*a* mounted between them to ensure that as one lever 42 descends, the other is raised. The user can stand on detachable step units 45 fitted to the ends of the levers 42 and exert pressure alternately on the step units while holding on to the handles. Fixed handles 46 can be mounted on the frame 25 to steady the user when standing on the step units 45 on the side of the flywheel 14 remote from the seat 21. As pressure is exerted on the one step unit and released on the other, the one lever 42 will descend and cause the rocking lever 44 to prise the other lever against the user's foot. The ratchet connections 43 ensure that only the downward movement of the two levers is transmitted to the flywheel to cause it to rotate anti-clockwise.

Figure 9:
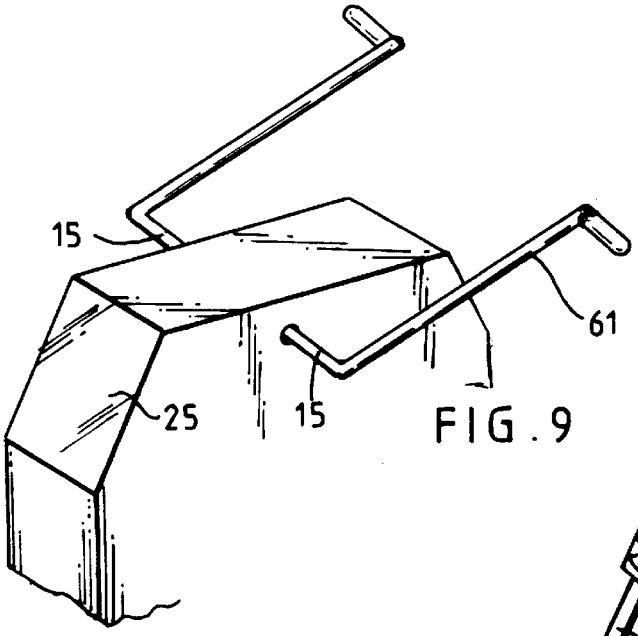
FIG. 9 shows drive levers with ratchet connections to an input shaft and handles at their free ends.

As shown in FIG. 9, levers 53 can be connected to the ends of the input shaft for independent movement. This could be achieved by independently rotative coaxial shafts connected to respective levers, but is preferably arranged as illustrated by having a single shaft 15 with ratchet type connections 57 to each lever, each ratchet allowing free movement of the levers anti-clockwise as seen in the figures, but providing a drive to the shaft 15 when either lever 53 moves clockwise. This mimics a boxing exercise. With this arrangement, only the drive mechanism of FIG. 3 is effective to drive the flywheel shaft 34 since the mechanism of FIG. 2 has oppositely directed freewheels/ratchets at its ends. The ratchet connections 52 on the levers could have their drive directions reversed so that the user pulls rather than pushes, mimicking pulling a rope or alternate rowing, and in this case the drive mechanism of FIG. 2 is effective and that of FIG. 3 ineffective.

Figure 10:
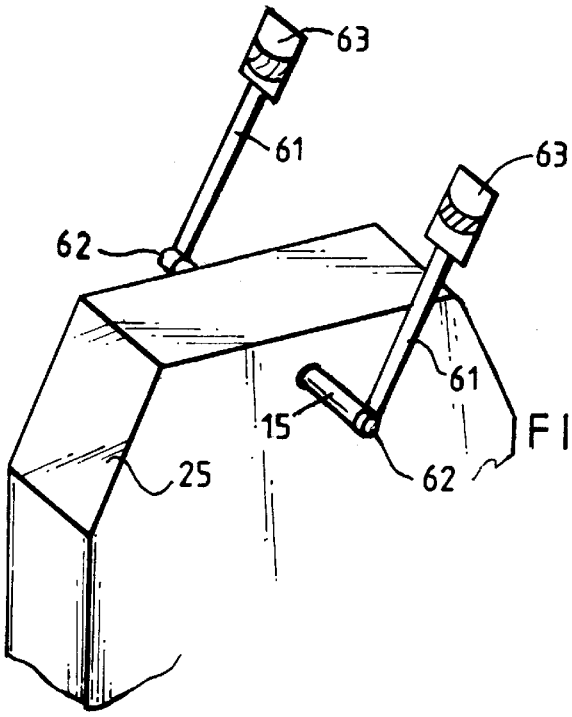
FIG. 10 shows drive levers and foot pedals at their free ends.
Figure 11:
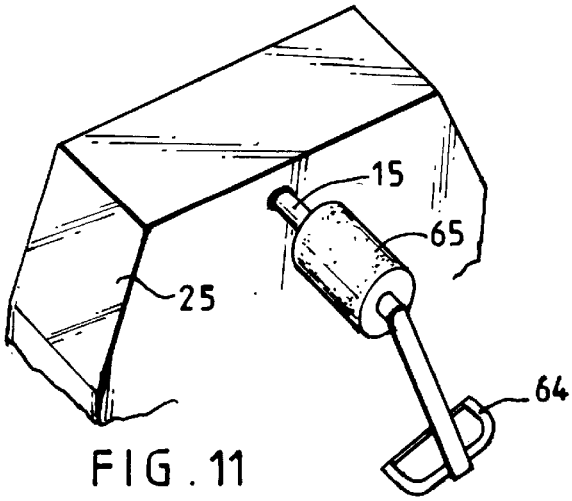
FIG. 11 is a variation of FIG. 10 for different leg exercises.

The skilled reader can devise many other positions for the user to cause the input shaft to rotate in an oscillatory manner in order to exercise different groups of muscles of the body. It is of course possible to combine direct drive of the flywheel by means of the foot pedals and drive through the chain mechanism by forces exerted by his or her arms. It is also possible for foot pedals to be fitted to the input shaft 15, for the operate while lying down on the bench formed by the parallel portions 23 and 24. An example of this is shown in FIG. 10 where levers 61 similar to those of FIG. 9 are fitted to the ends of the shaft 15 by ratchet connections 62, the free ends of the levers being providing with foot-plates and straps 63 to allow the user to do alternate leg-presses from a supine position on the portions 23/24 laid out flat. FIG. 11 shows another variation where a different foot-holding attachment 64 at the free end of each level holds the user's ankle while he or she performs leg curls and extensions. A pad 65 is provided on each end of the shaft 15 in this embodiment to support the back of the user's knee.

If sufficient gearing up could be achieved between the shaft 15 and the flywheel in a single chain drive, then the intermediate shaft 17 could be omitted and the drive taken directly between shaft 15 and shaft 34. As so far as described, the input shaft is unitary and the levers attached to its ends move in synchronism. In this case the drive loops between the shaft 15 and the intermediate shaft 32 of the mechanism of FIGS. 2 and 3 work together, and it would be possible for one of them to be omitted, the drives only separating after the intermediate shaft 32. However, when the user operates the two levers asynchronously as in FIG. 9 with or without the ratchet connections, the separate drive connections from the shaft 15 towards the flywheel 14 would be required.

What is claimed is:

1. An exercise device comprising:

a flywheel having an axis of rotation;

oscillatory drive means having a single rotary input shaft and operable by a human user, said oscillatory drive means including a lever for imparting oscillatory rotary motion to the input shaft; and two drive connection means for converting operation of the oscillatory drive means into rotary drive of the flywheel, one drive connection means converting clockwise rotation of the input shaft of the oscillatory drive means into rotation of the flywheel in a first direction and the other drive connection means converting counterclockwise rotation of the input shaft of the oscillatory drive means into rotation of the flywheel in the first direction.

2. An exercise device as claimed in claim 1 wherein said lever is detachably connected to the input shaft.

3. An exercise device as claimed in claim 1 wherein each drive connection means is connected to the flywheel through a freewheel, providing a drive connection from the drive connection means to the freewheel in the appropriate direction but freewheeling in the opposite direction.

4. An exercise device as claimed in claim 1 wherein the two drive connection means are arranged on opposite sides of the flywheel, spaced axially therefrom.

5. An exercise device as claimed in claim 1 comprising an operator support having two portions, a first portion to act as a seat and a second portion, hinged to the first portion, movable between a position in which it forms a back to the seat and a position in which it forms an extension of the seat.

6. An exercise device as claimed in claim 1 comprising a frame on which the flywheel and oscillatory drive means are mounted, a seat mounted on the frame on one side of the flywheel axis and a reaction plate connected to the frame on the other side of the flywheel axis for supporting the user and providing a counterbalance to operation of the oscillatory drive means by the user.

7. An exercise device as claimed in claim 6 wherein the reaction plate is detachable.

8. An exercise device as claimed in claim 1 comprising a pair of levers arranged to rotate the input shaft in the same direction through ratchet connections and a rocking lever arranged to cause one lever to move in the direction in which its ratchet connection does not rotate the input shaft when the other lever moves in the direction in which its ratchet connection causes the input shaft to rotate.

9. An exercise device as claimed in claim 1, further comprising a pair of pedals connected to the flywheel for imparting rotary drive to the flywheel.

10. An exercise device as claimed in claim 9, wherein the pedals are rotatable about the same axis as the flywheel.

11. An exercise device as claimed in claim 1, further comprising a pair of levers for imparting oscillatory rotary motion to said input shaft, one of said pair of levers mounted on each end of said input shaft such that said pair of levers are operable by either both arms or both legs of the user.

12. An exercise device as claimed in claim 11, wherein each of said pair of levers is connected to said input shaft with a ratchet connection such that each of said pair of levers rotates the input shaft in one direction and rotation of the input shaft in the same direction does not impart rotary motion to said pair of levers.

13. An exercise device as claimed in claim 1, wherein each of said two drive connection means comprises a flexible drive band which mates with a respective drive wheel mounted coaxially with said flywheel and attached to said flywheel with a one-way clutch, said flexible band of said one drive connection means mating with its respective drive wheel one side of said flywheel axis and said flexible band of said other drive connection means mating with its respective drive wheel on the opposite side of said flywheel axis.

14. An exercise device as claimed in claim 13, wherein said flexible drive bands comprise chains and said drive wheels comprise sprockets.

* * * * *